US011014778B2

(12) United States Patent
Piedra et al.

(10) Patent No.: US 11,014,778 B2
(45) Date of Patent: May 25, 2021

(54) RESCUE CONTROL AND METHOD OF OPERATING AN ELEVATOR SYSTEM INCLUDING A PERMANENT MAGNET (PM) SYNCHRONOUS MOTOR DRIVE SYSTEM

(71) Applicant: Otis Elevator Company, Farmington, CT (US)

(72) Inventors: Edward D. Piedra, Chicopee, MA (US); Prasanna Nagarajan, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 650 days.

(21) Appl. No.: 15/750,955

(22) PCT Filed: Aug. 3, 2016

(86) PCT No.: PCT/US2016/045384
§ 371 (c)(1),
(2) Date: Feb. 7, 2018

(87) PCT Pub. No.: WO2017/027296
PCT Pub. Date: Feb. 16, 2017

(65) Prior Publication Data

US 2018/0244492 A1 Aug. 30, 2018

Related U.S. Application Data

(60) Provisional application No. 62/202,282, filed on Aug. 7, 2015.

(51) Int. Cl.
*B66B 1/30* (2006.01)
*B66B 5/02* (2006.01)
(Continued)

(52) U.S. Cl.
CPC ..... *B66B 1/308* (2013.01); *B66B 5/027* (2013.01); *B66B 9/00* (2013.01); *B66B 11/043* (2013.01)

(58) Field of Classification Search
CPC ..... B66B 1/30; B66B 5/0031; B66B 5/027; B66B 5/02; B66B 5/024; B66B 5/0006;
(Continued)

(56) References Cited

U.S. PATENT DOCUMENTS 4,484,664 A 11/1984 Nomura
5,070,290 A 12/1991 Iwasa et al.
(Continued)

FOREIGN PATENT DOCUMENTS

CN 1175816 A 3/1998
CN 1221703 A 7/1999
(Continued)

OTHER PUBLICATIONS

International Search Report and Written Opinion for application PCT/US2016/045495, dated Nov. 16, 2016, 13 pages.
(Continued)

*Primary Examiner* — Marlon T Fletcher
(74) *Attorney, Agent, or Firm* — Cantor Colburn LLP

(57) ABSTRACT

A permanent magnet (PM) synchronous electric motor (34) includes a plurality of phases, and a plurality of motor drives (55,58) electrically connected to the PM synchronous electric motor. Each of the motor drives is operatively connected to a corresponding one of the plurality of phases. The plurality of motor drives is configured and disposed to deliver a torque current divided equally between each of the plurality of phases and independently deliver flux current to the corresponding one of the plurality of phases. A controller (44) is operatively connected to each of the plurality of motor drives to selectively control the PM synchronous
(Continued)

electric motor, and a rescue module (120) operatively connected to the controller, the rescue module being configured and disposed to determine a failure of one of the plurality of motor drives and control the PM synchronous electric motor in a reduced operation profile employing remaining ones of the plurality of motor drives.

17 Claims, 3 Drawing Sheets

(51) Int. Cl.
*B66B 9/00* (2006.01)
*B66B 11/04* (2006.01)

(58) Field of Classification Search
CPC ..... B66B 5/0018; B66B 5/0093; B66B 5/021; B66B 5/028; B66B 11/04; B66B 9/0838
See application file for complete search history.

(56) References Cited

U.S. PATENT DOCUMENTS 5,241,255 A 8/1993 Oshima et al.
5,821,476 A 10/1998 Hakala et al.
5,896,948 A 4/1999 Suur-Askola et al.
6,264,005 B1 * 7/2001 Kang ..... B66B 5/027 187/290
6,269,910 B1 8/2001 Fargo et al.
7,956,563 B2 6/2011 Perisic et al.
8,016,061 B2 9/2011 Jeon et al.
8,146,714 B2 4/2012 Blasko
8,230,978 B2 7/2012 Agirman et al.
8,264,190 B2 9/2012 Suzuki
8,314,577 B2 11/2012 Takeuchi et al.
8,400,092 B2 3/2013 Kasunich et al.
8,405,341 B2 3/2013 Tagome
8,493,032 B2 7/2013 Krauer
8,659,260 B2 2/2014 Mukai et al.
8,729,745 B2 5/2014 Gan et al.
8,742,713 B2 6/2014 Ng
8,841,872 B2 9/2014 Pasuri et al.
8,899,383 B2 12/2014 De Coi et al.
8,952,645 B2 2/2015 Fraeger
9,018,880 B2 4/2015 Hayashi
9,571,024 B1 2/2017 Yuan et al.
2003/0011331 A1 1/2003 Minagawa et al.
2006/0137941 A1 * 6/2006 Andrejak ..... B66B 5/027 187/293
2008/0185233 A1 8/2008 Tegtmeier et al.
2008/0202859 A1 8/2008 Tegtmeier et al.
2009/0033274 A1 2/2009 Perisic et al.
2011/0074333 A1 3/2011 Suzuki
2011/0120810 A1 5/2011 Schroeder-Brumloop et al.
2011/0204839 A1 8/2011 Mukai et al.
2012/0013284 A1 1/2012 Campbell
2012/0013285 A1 1/2012 Kasunich et al.
2012/0098355 A1 4/2012 Gan et al.
2013/0025974 A1 * 1/2013 Piech ..... B66B 5/02 187/289
2014/0027209 A1 * 1/2014 Kallioniemi ..... B66B 5/0018 187/391
2014/0207335 A1 7/2014 Mikamo et al.
2015/0053508 A1 2/2015 Kattainen et al.
2015/0069949 A1 3/2015 Mohammadpour et al.
2015/0075915 A1 3/2015 Stolt et al.
2015/0122589 A1 5/2015 Mezzadri et al.
2016/0068368 A1 * 3/2016 Hovi ..... B66B 1/343 187/247
2016/0315565 A1 10/2016 Vuletic et al.
2018/0222724 A1 8/2018 Piedra
2019/0020227 A1 1/2019 Umemori
2020/0122960 A1 * 4/2020 Valdivia Guerrero ..... H02M 3/158
2020/0122961 A1 * 4/2020 Valdivia Guerrero ..... B66B 1/308

FOREIGN PATENT DOCUMENTS

CN 1530315 A 9/2004
CN 1972856 A 5/2007
CN 101044081 A 9/2007
CN 101741295 A 6/2010
CN 102491137 A 6/2012
CN 102497054 A 6/2012
CN 202334120 U 7/2012
CN 102712444 A 10/2012
CN 102714483 A 10/2012
CN 103291552 A 9/2013
CN 203383981 U 1/2014
CN 103560738 A 2/2014
CN 104716786 A 6/2015
EP 2604563 A1 6/2013
JP 2004238138 A 8/2004
JP 2008156071 A 7/2008
KR 20120041318 A 5/2012
WO 2014108599 A1 7/2014
WO 2015036650 A1 3/2015
WO 2015105510 A1 7/2015

OTHER PUBLICATIONS

Levi, Professor E., "Parallel-Connected Multi-Drive Systems With Reduced Number of Inverter Legs and Independent Vector Control", Liverpool John Moores University, EP/C007395/1, available at: http://gow.epsrc.ac.uk/NGBOViewGrant.aspx?GrantRef=EP/C007395/1, accessed Feb. 8, 2018, 2 pages.
Quick, Darren, "Mitsubishi develops ultra-high speed elevator technology", Feb. 3, 2012, available at: https:/newatlas.com/mitsubishi-ultra-high-speed-elevator/21324/, 5 pages.
International Search Report and Written Opinion for application PCT/US2016/045384, dated Nov. 14, 2016, 14 pages.
Jung, Eunsoo, et al., "A Nine-Phase Permanent-Magnet Motor Drive System for an Ultrahigh-Speed Elevator", IEEE Transactions on Industry Applications, vol. 48, No. 3, May/Jun. 2012, pp. 987-995.
Chinese First Office Action for application CN 201680046550.4, dated Jul. 2, 2019, 6 pages.
U.S. Non-Final Office Action for U.S. Appl. No. 15/750,964; Issued Sep. 17, 2020; 23 Pages.

* cited by examiner

RESCUE CONTROL AND METHOD OF OPERATING AN ELEVATOR SYSTEM INCLUDING A PERMANENT MAGNET (PM) SYNCHRONOUS MOTOR DRIVE SYSTEM

BACKGROUND

Exemplary embodiments pertain to the art of elevator systems and, more particularly, to an elevator system having a permanent magnet (PM) synchronous motor drive system.

Conveyance systems, such as elevator systems, use machines to impart force to a car carrying passengers. The machines employed may need to provide varying power levels depending on the application. When an elevator requires a large elevator duty or load, a drive needs be provided to power the elevator machine. Often, a high power drive may not exist, which results in high design costs and lengthy development time to manufacture a suitable drive. Even if a single, large drive exists in the marketplace, costs associated with a single, large drive may be excessive due to specialty components, component availability, etc.

BRIEF DESCRIPTION

Disclosed is an elevator drive system including a permanent magnet (PM) synchronous electric motor including a plurality of phases, and a plurality of motor drives electrically connected to the PM synchronous electric motor. Each of the plurality of motor drives is operatively connected to a corresponding one of the plurality of phases. The plurality of motor drives is configured and disposed to deliver a torque current divided equally between each of the plurality of phases and independently deliver flux current to the corresponding one of the plurality of phases. A controller is operatively connected to each of the plurality of motor drives to selectively control the PM synchronous electric motor, and a rescue module operatively connected to the controller. The rescue module is configured and disposed to determine a failure of one of the plurality of motor drives and control the PM synchronous electric motor in a reduced operation profile employing remaining ones of the plurality of motor drives.

In addition to one or more of the features described above or below, or as an alternative, further embodiments could include wherein one of the plurality of motor drives is designated as a primary motor drive and remaining ones of the plurality of motor drives are designated as secondary motor drives.

In addition to one or more of the features described above or below, or as an alternative, further embodiments could include wherein the rescue module designates one of the secondary motor drives as a temporary primary motor drive in the event of a failure of the primary motor drive.

In addition to one or more of the features described above or below, or as an alternative, further embodiments could include wherein upon determining a failure of one of the plurality of motor drives, the rescue module is configured and disposed to signal remaining ones of the plurality of motor drives to deliver a torque current divided equally between each of the plurality of phases associated with the remaining ones of the plurality of motor drives.

In addition to one or more of the features described above or below, or as an alternative, further embodiments could include wherein the rescue module is configured and disposed to signal the remaining ones of the plurality of motor drives to adjust flux current to account for the failure of the one of the plurality of motor drives.

Also disclosed is an elevator system including a hoistway, a car movably arranged with the hoistway, and an elevator drive system operatively connected to the car. The elevator drive system includes a permanent magnet (PM) synchronous electric motor operatively connected to the car. The PM synchronous electric motor includes a plurality of phases. A plurality of motor drives is electrically connected to the PM synchronous electric motor. Each of the plurality of motor drives is operatively connected to a corresponding one of the plurality of phases. The plurality of motor drives is configured and disposed to equally deliver torque current to each of the plurality of phases and independently deliver flux current to the corresponding one of the plurality of phases. A controller is operatively connected to each of the plurality of motor drives to selectively control the PM synchronous electric motor, and a rescue module is operatively connected to the controller. The rescue module is configured and disposed to determine a failure of one of the plurality of motor drives and control the PM synchronous electric motor in a reduced operation profile employing remaining ones of the plurality of motor drives.

In addition to one or more of the features described above or below, or as an alternative, further embodiments could include wherein one of the plurality of motor drives is designated as a primary motor drive and remaining ones of the plurality of motor drives are designated as secondary motor drives.

In addition to one or more of the features described above or below, or as an alternative, further embodiments could include wherein the rescue module designates one of the secondary motor drives as a temporary primary motor drive in the event of a failure of the primary motor drive.

In addition to one or more of the features described above or below, or as an alternative, further embodiments could include wherein upon determining a failure of one of the plurality of motor drives, the rescue module is configured and disposed to signal remaining ones of the plurality of motor drives to deliver a torque current divided equally between each of the plurality of phases associated with the remaining ones of the plurality of motor drives.

In addition to one or more of the features described above or below, or as an alternative, further embodiments could include wherein the rescue module is configured and disposed to signal the remaining ones of the plurality of motor drives to adjust flux current to account for the failure of the one of the plurality of motor drives.

Further disclosed is a method of operating an elevator system having a permanent magnet (PM) synchronous electric motor and a plurality of motor drives equally distributing torque current to each of a plurality of associated phases of the PM synchronous electric motor in a reduced operating profile. The method includes identifying one of the plurality of motor drives as a faulty drive, initiating a reduced operation profile for remaining ones of the plurality of motor drives, determining whether continued reduced operation profile operation is indicated, and moving an elevator car to a rescue floor if continued reduced profile operation is contraindicated.

In addition to one or more of the features described above or below, or as an alternative, further embodiments could include wherein identifying one of the plurality of motor drives as a faulty motor drive includes identifying whether the faulty motor drive is one of a primary motor drive and a secondary motor drive.

In addition to one or more of the features described above or below, or as an alternative, further embodiments could include designating a secondary motor drive as a temporary primary motor drive if the faulty motor drive is the primary motor drive.

In addition to one or more of the features described above or below, or as an alternative, further embodiments could include distributing torque current substantially equally to the associated ones of the plurality of phases through the remaining ones of the plurality of motor drives.

In addition to one or more of the features described above or below, or as an alternative, further embodiments could include signaling the remaining ones of the plurality of motor drives to adjust flux current to account for the failure of the one of the plurality of motor drives.

In addition to one or more of the features described above or below, or as an alternative, further embodiments could include wherein moving the elevator car to a rescue floor includes moving the elevator car along a hoistway to a next adjacent floor.

In addition to one or more of the features described above or below, or as an alternative, further embodiments could include determining a load in the elevator car relative to a weight of a counterweight of the elevator system.

In addition to one or more of the features described above or below, or as an alternative, further embodiments could include shifting the elevator car upward to the next adjacent floor if the load in the elevator car is less than the weight of the counterweight.

In addition to one or more of the features described above or below, or as an alternative, further embodiments could include shifting the elevator car downward to the next adjacent floor if the load in the elevator car is greater than the weight of the counterweight.

In addition to one or more of the features described above or below, or as an alternative, further embodiments could include wherein determining whether continued reduced operation profile operation is indicated includes determining one of a number of motor drive failures, a type of motor drive failure and a designation of each failed motor drive.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
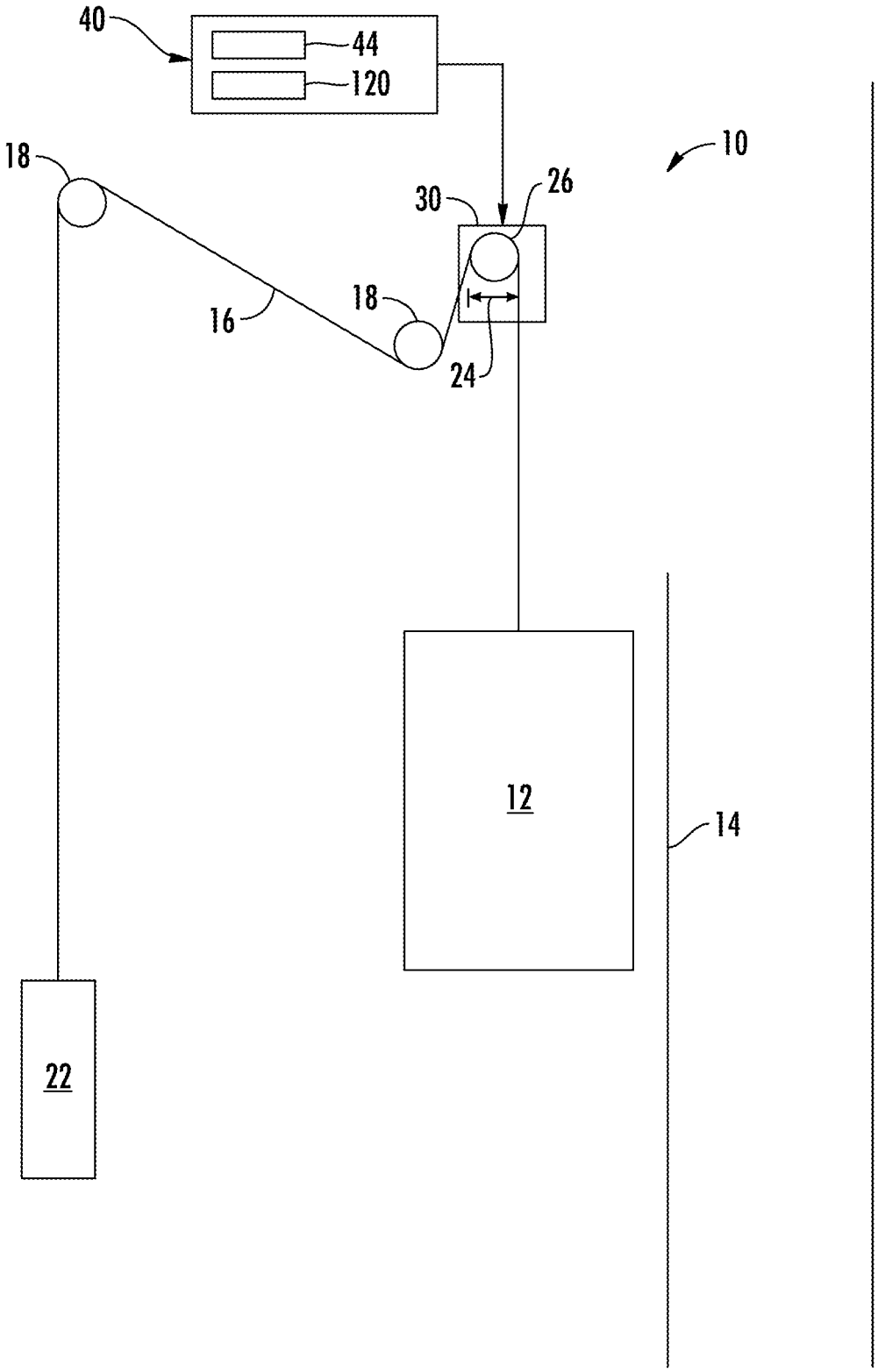
FIG. 1 illustrates an elevator system including a permanent magnet (PM) synchronous electric motor and drive system, in accordance with an exemplary embodiment.

A traction elevator system, in accordance with an exemplary embodiment, is illustrated generally at 10, in FIG. 1. Features of elevator system 10 that are not required for an understanding of the present disclosure (such as the guide rails, safeties, etc.) are not discussed herein. Elevator system 10 includes an elevator car 12 operatively suspended or supported in a hoistway 14 with a belt or rope 16. It should be understood that the number and/or arrangement of belts 16 could vary. Belt 16 interacts with one or more sheaves 18 to be routed around various components of the elevator system 10. Belts 16 could also be connected to a counterweight 22, which is used to help balance the elevator system 10 and reduce differences in belt 16 tension during operation.

Sheaves 18 each have a diameter 24, which may be the same or different than the diameters of the other sheaves 18 in the elevator system 10. At least one of sheaves 18 could be a traction sheave 26. Traction sheave 26 is driven by a machine system 30. Movement of traction sheave 26 by machine system 30 drives, moves and/or propels (through traction) belt 16. FIG. 1 depicts a 1:1 roping arrangement. However, it should be understood that elevator system 10 may include various different roping arrangements including 2:1 roping arrangements. Exemplary embodiments may also employ a cantilevered type elevator car.

Figure 2:
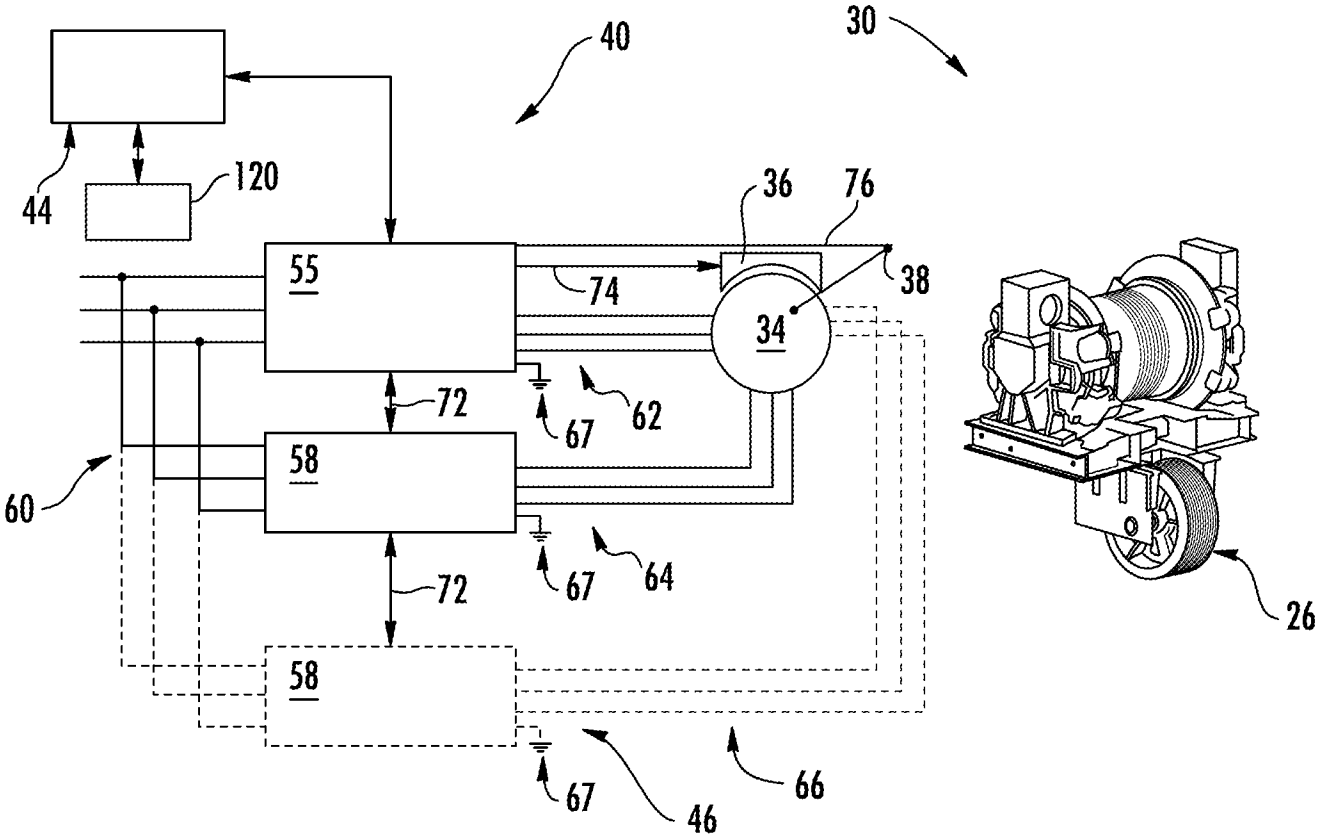
FIG. 2 is a schematic representation of the PM synchronous electric motor and drive system of FIG. 1.

In accordance with an aspect of an exemplary embodiment illustrated in FIG. 2, machine system 30 includes an electric motor 34. In accordance with an aspect of an exemplary embodiment, electric motor 34 may take the form of a permanent magnet (PM) synchronous electric motor including a brake 36 and an encoder 38. PM synchronous electric motor 34 is operatively coupled to an elevator drive system 40 having a controller 44 and a plurality of motor drives 46. Motor drives 46 include a primary motor drive 55 and one or more secondary motor drives 58. Controller 44 delivers signals to primary motor drive 55 which, in turn, may deliver signals to secondary motor drives 58 as will be detailed more fully below.

In accordance with an aspect of an exemplary embodiment, elevator drive system 40 includes a three-phase or line voltage input 60. Primary motor drive 55 includes a three-phase output 62 and each secondary motor drive 58 includes a corresponding three-phase output 64 and 66. Additionally, primary motor drive 55 and each secondary motor drive 58 include a dedicated, independent, e.g., not shared, ground 67. In further accordance with an aspect of an exemplary embodiment, each three-phase output 62, 64 and 66 is independent of others of three-phase outputs 62, 64 and 66 and connects to a separate independent winding (not separately labeled) of PM synchronous electric motor 34. Further, it should be understood that the number of motor drives and corresponding independent three-phase outputs passing to PM synchronous electric motor 34 could vary. For example, PM synchronous electric motor 34 could be powered solely by primary motor drive 55 and secondary motor drive 58 representing a six-phase motor. In other embodiments, three-phase output 66 may establish a nine-phase configuration, or a twelve-phase configuration.

In further accordance with an aspect of an exemplary embodiment, primary motor drive 55 is operatively connected to each secondary motor drive 58 through a corresponding first control line 72. Primary motor drive 55 is also connected to brake 36 through a second control line 74 and to an encoder 38 through a third control line 76. With this arrangement, primary motor drive 55 communicates with controller 44 and provides converter control for PM synchronous electric motor 34 as well as inverter control. Primary motor drive 55 also interacts with PM synchronous electric motor 34 to regulate current, and voltage as well as provide velocity control, brake control, and a locked rotor test (LRT) for PM synchronous electric motor 34.

In yet still further accordance with an exemplary aspect, primary motor drive 55 communicates with each secondary motor drive 58 to establish/set a desired field orientation angle for each secondary motor drive 58 as well as to provide a desired torque current command. Primary motor drive 55 also communicates velocity commands; prepare to run commands; as well as any synchronization logic. In this manner, torque current (Q-Axis) to PM synchronous electric motor 34 may be divided substantially equally between each secondary motor drive 58 and flux current (D-Axis) may be independently controlled by each secondary motor drive 58.

In accordance with an aspect of an exemplary embodiment, controller 44 includes a rescue module 120 that monitors operation of primary motor drive 55 and each secondary motor drive 58. Rescue module 120 may form part of controller 44 or may represent a separate element operatively connected to controller 44. As will be detailed more fully below, rescue module 120 may activate a rescue operation for elevator car 12 in the event of an operational error in primary motor drive 55 and/or one or more of secondary motor drives 58. For example, in the event that primary motor drive 55 experiences an operational error, rescue module 120 may re-designate one of secondary motor drives 58 as a temporary primary motor drive in order to operate at a reduced profile. Temporary primary motor drive will operate as the primary motor drive and operations may be spread through remaining ones of secondary motor drives 58. Likewise, in the event of a failure of one of secondary motor drives 58, operations may be re-distributed to remaining ones of secondary motor drives 58 and/or primary motor drive 55.

Figure 3:
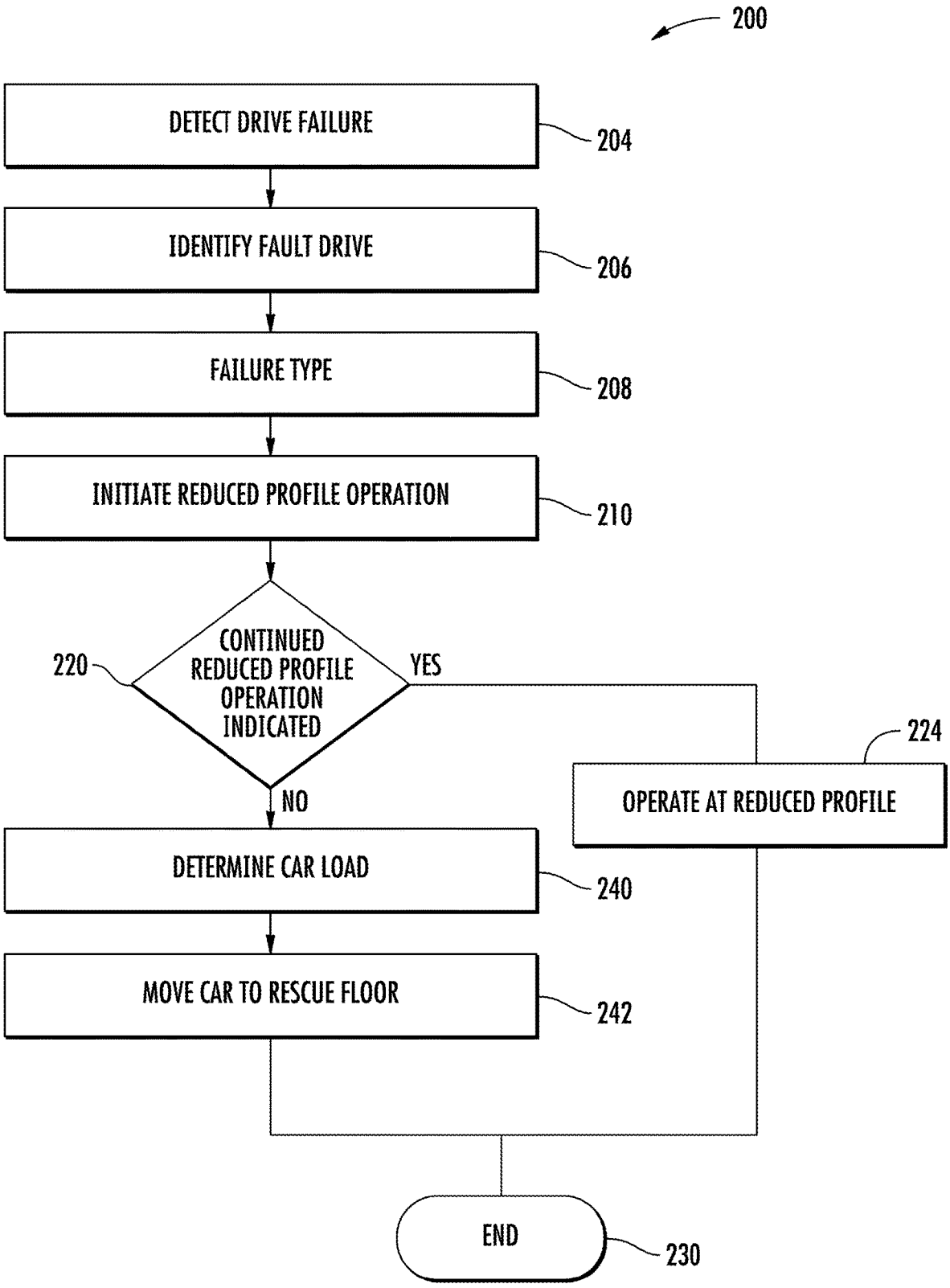
FIG. 3 depicts a flow chart illustrating a method of rescuing an elevator car, in accordance with an aspect of an exemplary embodiment.

Reference will now follow to FIG. 3 in describing a method 200 of rescuing an elevator car in accordance with an exemplary embodiment. A drive failure may be detected in block 204. The drive failure may be detected by controller 44 and/or rescue module 120. In block 206 the drive failure is identified as being associated with primary motor drive 55 and/or any one of secondary motor drives 58. In block 208, rescue module 120 may identify a failure type and in block 210 a reduced operation profile is initiated.

In further accordance with an exemplary embodiment, a determination is made, in block 220, whether continued reduced profile operation is indicated, or whether the elevator car 12 should be brought to a rescue floor and further operation suspended. The determination of whether continued or prolonged reduced profile operation may be appropriate may take into account failure type, number and type, e.g., designation as primary or secondary, of a failed drive or drives, etc. If continued reduced profile operation is indicated in block 220, controller 44 will continue to shift elevator car 12 in response to call button inputs in a reduced operation mode in block 224 until any necessary repairs are made and reduced profile operation ends in block 230.

If continued reduced profile operation is contraindicated in block 220, rescue module 120 may determine a load value in elevator car 12 in block 240. After determining a load value, rescue module 120 may control machine system 30 in the reduced profile operation for the purpose of shifting elevator car 12 to a rescue floor in block 242. A rescue floor may be a next adjacent floor. If for example elevator car 12 is light, e.g., the load value of elevator car 12 is less than a weight of counterweight 22, rescue module 120 may direct elevator car 12 upward to the next adjacent floor. Conversely, if the load value of elevator car 12 is greater than that of counterweight 22, rescue module 120 may direct elevator car 12 downward to the next adjacent floor. After being directed to the rescue floor, elevator car 12 may be taken out of service until any necessary repairs can be made and rescue operations ended in block 230.

At this point, it should be understood that exemplary embodiments describe a multi-drive control for a PM synchronous electric motor. The multi-drive control may include a number of secondary motor drives communicating with a single primary motor drive. Further, each motor drive includes an independent, multi-phase output to a separate independent winding of the PM synchronous electric motor. Further, the multi-drive system maintains no common neutrals between motor drives. Thus, in the event of a failure of one of the motor drives, the primary motor drive may maintain control of the PM synchronous electric motor, re-divide the torque current through any remaining secondary motor drives and associated phases, and establish a new flux current angle to allow continued operation. If a failure occurs in the primary motor drive, one of the secondary motor drives may be re-designated as a primary motor drive to provide continued control. When employed in an elevator system, the exemplary embodiments provide control over movement of the elevator car in the event of a failure of one or more of the motor drives. In this manner, the elevator car may be operated at reduced capacity and/or moved to a floor and parked until repairs may be completed.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator drive system comprising:

a permanent magnet (PM) synchronous electric motor including a plurality of phases;

a plurality of motor drives electrically connected to the PM synchronous electric motor, each of the plurality of motor drives being operatively connected to a corresponding one of the plurality of phases, the plurality of motor drives being configured and disposed to deliver a torque current divided equally between each of the plurality of phases and independently deliver flux current to the corresponding one of the plurality of phases;

a controller operatively connected to each of the plurality of motor drives to selectively control the PM synchronous electric motor; and a rescue module operatively connected to the controller, the rescue module being configured and disposed to determine a failure of one of the plurality of motor drives and control the PM synchronous electric motor in a reduced operation profile employing remaining ones of the plurality of motor drives;

wherein one of the plurality of motor drives is designated as a primary motor drive and remaining ones of the plurality of motor drives are designated as secondary motor drives.

2. The elevator drive system according to claim 1, wherein the rescue module designates one of the secondary motor drives as a temporary primary motor drive in the event of a failure of the primary motor drive.

3. The elevator drive system according to claim 1, wherein upon determining a failure of one of the plurality of motor drives, the rescue module is configured and disposed to signal remaining ones of the plurality of motor drives to deliver a torque current divided equally between each of the plurality of phases associated with the remaining ones of the plurality of motor drives.

4. The elevator drive system according to claim 3, wherein the rescue module is configured and disposed to signal the remaining ones of the plurality of motor drives to adjust flux current to account for the failure of the one of the plurality of motor drives.

5. An elevator system comprising:

a hoistway;

a car movably arranged with the hoistway; and an elevator drive system operatively connected to the car, the drive system comprising:

a permanent magnet (PM) synchronous electric motor operatively connected to the car, the PM synchronous electric motor including a plurality of phases;

a plurality of motor drives electrically connected to the PM synchronous electric motor, each of the plurality of motor drives being operatively connected to a corresponding one of the plurality of phases, the plurality of motor drives being configured and disposed to equally deliver torque current to each of the plurality of phases and independently deliver flux current to the corresponding one of the plurality of phases;

a controller operatively connected to each of the plurality of motor drives to selectively control the PM synchronous electric motor; and a rescue module operatively connected to the controller, the rescue module being configured and disposed to determine a failure of one of the plurality of motor drives and control the PM synchronous electric motor in a reduced operation profile employing remaining ones of the plurality of motor drives;

wherein one of the plurality of motor drives is designated as a primary motor drive and remaining ones of the plurality of motor drives are designated as secondary motor drives.

6. The elevator system according to claim 5, wherein the rescue module designates one of the secondary motor drives as a temporary primary motor drive in the event of a failure of the primary motor drive.

7. The elevator system according to claim 5, wherein upon determining a failure of one of the plurality of motor drives, the rescue module is configured and disposed to signal remaining ones of the plurality of motor drives to deliver a torque current divided equally between each of the plurality of phases associated with the remaining ones of the plurality of motor drives.

8. The elevator system according to claim 7, wherein the rescue module is configured and disposed to signal the remaining ones of the plurality of motor drives to adjust flux current to account for the failure of the one of the plurality of motor drives.

9. A method of operating an elevator system having a permanent magnet (PM) synchronous electric motor and a plurality of motor drives equally distributing torque current to each of a plurality of associated phases of the PM synchronous electric motor in a reduced operating profile comprising:

identifying one of the plurality of motor drives as a faulty drive;

initiating a reduced operation profile for remaining ones of the plurality of motor drives;

determining whether continued reduced operation profile operation is indicated; and moving an elevator car to a rescue floor if continued reduced profile operation is contraindicated;

wherein identifying one of the plurality of motor drives as a faulty motor drive includes identifying whether the faulty motor drive is one of a primary motor drive and a secondary motor drive.

10. The method of claim 9, further comprising: designating a secondary motor drive as a temporary primary motor drive if the faulty motor drive is the primary motor drive.

11. The method of claim 9, further comprising: distributing torque current substantially equally to the associated ones of the plurality of phases through the remaining ones of the plurality of motor drives.

12. The method of claim 9, further comprising: signaling the remaining ones of the plurality of motor drives to adjust flux current to account for the failure of the one of the plurality of motor drives.

13. The method of claim 9, wherein moving the elevator car to a rescue floor includes moving the elevator car along a hoistway to a next adjacent floor.

14. The method of claim 13, further comprising: determining a load in the elevator car relative to a weight of a counterweight of the elevator system.

15. The method of claim 14, further comprising: shifting the elevator car upward to the next adjacent floor if the load in the elevator car is less than the weight of the counterweight.

16. The method of claim 14, further comprising: shifting the elevator car downward to the next adjacent floor if the load in the elevator car is greater than the weight of the counterweight.

17. The method of claim 9, wherein determining whether continued reduced operation profile operation is indicated includes determining one of a number of motor drive failures, a type of motor drive failure and a designation of each failed motor drive.

* * * * *